US005417603A

United States Patent [19]

De Chazal

[11] Patent Number: 5,417,603

[45] Date of Patent: May 23, 1995

[54] PLAYING STRUCTURE AND STORAGE SYSTEM AND MODULES THEREFOR

[75] Inventor: Robert De Chazal, Edmonton, Canada

[73] Assignee: Alberta Limited, Calgary, Canada

[21] Appl. No.: 61,315

[22] Filed: May 14, 1993

Related U.S. Application Data

[63] Continuation-in-part of Ser. No. 13,324, Feb. 4, 1993, abandoned.

[51] Int. Cl.[6] ..... A63H 33/04; A47B 57/00

[52] U.S. Cl. ..... 446/75; 446/85; 108/62; 273/309

[58] Field of Search ..... 446/75, 85, 444, 124, 446/111; 273/309, 157 R; 434/72, 150–152; 108/62, 50, 64, 90, 111; 238/10 B

[56] References Cited

U.S. PATENT DOCUMENTS

| | | | |
|---|---|---|---|
| 522,014 | 6/1894 | Hunzinger | 108/62 |
| 2,674,813 | 4/1954 | Hutchinson | 434/152 |
| 3,025,626 | 3/1962 | Schumacher | 238/10 B |
| 3,236,003 | 2/1966 | Flood, Jr. | 108/64 X |
| 3,674,271 | 4/1972 | De Gelder et al. . | |
| 3,755,923 | 9/1973 | Krahn | 273/157 R X |
| 3,871,655 | 3/1975 | Zimmers et al. | 108/150 X |
| 3,953,032 | 4/1976 | Moore et al. . | |
| 4,192,083 | 3/1980 | Rebbeck | 108/64 X |
| 4,346,889 | 8/1982 | Barlow et al. . | |
| 4,484,749 | 11/1984 | Charney . | |
| 4,534,566 | 8/1985 | Ferris et al. . | |
| 4,552,362 | 11/1985 | Oake | 273/309 X |
| 4,556,213 | 12/1985 | Sharma . | |
| 4,569,527 | 2/1986 | Rosenwinkel et al. . | |
| 4,696,476 | 9/1987 | Eplett | 273/241 |
| 4,733,867 | 3/1988 | Kemp et al. . | |
| 4,739,992 | 4/1988 | May . | |
| 4,953,786 | 9/1990 | Arsenault | 238/10 B |

FOREIGN PATENT DOCUMENTS

| | | | |
|---|---|---|---|
| 1070688 | 8/1954 | France | 446/124 |
| 1301456 | 12/1962 | France . | |
| 828518 | 2/1960 | United Kingdom | 434/152 |
| WO8505282 | 12/1985 | WIPO . | |

*Primary Examiner*—Mickey Yu

*Attorney, Agent, or Firm*—Fitzpatrick, Cella, Harper & Scinto

[57] ABSTRACT

A playing structure includes a plurality of playing structure modules connectable together to form an array having a generally continuous, visually fluid, three-dimensional playing surface. Each playing structure module has a reversible top to allow the topography of the playing surface to be changed. The top of each playing structure module has a different three-dimensional topography on either side thereof. Each playing structure module may have a different or the same top. The playing surfaces have a coloured landscape painted thereon to depict lakes, countrysides, roadways etc. and the like. The topography of the playing surfaces and the painted landscapes are designed so that the certain symmetries exist. In particular, when a plurality of playing structure modules are assembled to form an array and the tops of the playing structure modules are arranged to provide a playing surface having a continuous, visually fluid landscape, any one of or all of the tops can be reversed along a diagonal and the landscape of the resulting playing surface will still be continuous and visually fluid. This of course increases the number of different playing surfaces which can be created with the playing structure modules.

33 Claims, 13 Drawing Sheets

PLAYING STRUCTURE AND STORAGE SYSTEM AND MODULES THEREFOR

This is a continuation-in-part of Appln. Ser. No. 08/013,324, filed Feb. 4, 1993, abandoned.

FIELD OF THE INVENTION

The present invention relates to children's toys and in particular to a playing structure on which toys may be placed and moved thereon, a storage system for the toys and modules for use in the playing structure.

BACKGROUND OF THE INVENTION

Many children's toys are available which allow a child to build structures such as houses and the like and in effect create cities. Of the toys of this nature, one of the most common are building blocks commonly referred to as Lego®. These building blocks are best assembled on a playing surface where the child can move miniature vehicles, people and animals and rearrange the built structures.

Unfortunately children have very few supportive and convenient places to play with the above type of toys. In most households, the playing surface referred to above is constituted by a free space on a hardwood floor, an unoccupied table top or desk surface and in some instances the top of a bed. Each of these types of playing surfaces when used for play is limited and is inconvenient in some way. Moreover, these playing surfaces do not encourage or suggest directions for a child's fantasy. It is solely up to the child's imagination to transform the otherwise plain surface into one which has a varying topography and landscape.

Another disadvantage associated with these playing surfaces is that when the child is finished playing, the child's toys remain in the way.

To alleviate some of the above-mentioned problems, playing surfaces having printed presentations on which toys are to be moved have been considered. For example, U.S. Pat. No. 3,206,887 to Eyler et al discloses a children's toy in the form of a pad having a number of pages. Printed on one side of most of the pages in the pad are roadways while on the other pages are representations of vehicles which can be punched out from the pages. The pages with roadways printed thereon also have different locations of interest drawn on them and a legend indicating the drawn area of interest. The roadways are drawn on the sheets in a manner so that the roadway is continuous when two sheets are properly oriented and placed side by side. Although this provides a playing surface with roadways, the surface itself is relatively plain and does not resemble real terrain. In addition, the planar nature of the sheets requires an underlying support and therefore, this toy still suffers from many of the disadvantages discussed previously.

It is therefore an object of the present invention to provide a novel playing structure having a three-dimensional playing surface which resembles real terrain more closely than prior art playing surfaces and which is changeable to allow different playing surfaces to be created.

SUMMARY OF THE INVENTION

According to one aspect of the present invention there is provided a playing structure module comprising:

a reversible top; and a support to space vertically said top from the surface on which said support is located, said top having a pair of opposed playing surfaces, the opposed playing surfaces having a different three-dimensional topography and depicting a different landscape.

Preferably, the three-dimensional topographies on the opposed playing surfaces are generally complimentary in configuration. Preferably, the support is in the form of a frame having an open interior and a secondary surface located below the reversible top, the secondary surface being accessible through an opening in at least one side of the frame. It is also preferred that the secondary surface is accessible from all sides of the frame. In one embodiment, the secondary surface is a shelf to provide storage space for a child's toys after the child has finished playing with the playing structure module. In another embodiment, the secondary surface constitutes a secondary playing surface which itself may be reversible to provide secondary playing surfaces with different topographies. In this instance, it is preferred that the reversible top has at least one passage therethrough to permit access to the secondary playing surface.

In one embodiment, it is preferred that the frame is constituted by a plurality of interconnected frame members removably connected to one another. It is also preferred that the frame and the playing surfaces have complimentary formations thereon to inhibit relative lateral movement between the frame and the reversible top. It is also preferred that the topographies of the playing surfaces are stepped to provide generally planar, horizontal surfaces at different elevations which constitute support platforms for a child's toys.

In another embodiment, it is preferred that the reversible top is constituted by a plurality of reversible top elements, each of the top elements including a pair of opposed playing surfaces with the opposed playing surfaces having a different three-dimensional topography and depicting a different landscape, the landscapes on each playing surface being depicted such that the landscape is visually fluid over the entire top when any one or all of the top elements are reversed. Preferably, the topographies on the top elements are configured such that when the top elements are arranged to provide a continuous, visually fluid landscape, the top elements must be reversed along a diagonal to create a different continuous, visually fluid landscape. It is also preferred that retaining means act between the support and the top elements.

According to another aspect of the present invention there is provided a playing structure comprising:

a plurality of playing structure modules arranged in an array, each of said modules including a support and a reversible top on said support and vertically spaced from the surface on which said support is located, said reversible top having a pair of opposed playing surfaces, the opposed playing surfaces having a different three-dimensional topography and depicting a different landscape, the landscapes on each playing surface being such that the landscape of said playing structure is continuous and visually fluid over adjacent playing surfaces when any one or all of said reversible tops are reversed.

Preferably, the playing structure modules are releasably connectable to each other to form the array, with the playing structure modules being arrangeable in arrays of varying configurations to allow different shaped playing surfaces to be created, all with continuous, visually fluid landscapes. It is also preferred that the topography on the reversible tops is configured such that when the playing structure modules are arranged to provide a continuous, visually fluid landscape, the tops must be reversed along a diagonal to create a different continuous, visually fluid landscape. It is also preferred that the tops must be reversed along a North-West, South-East diagonal to create a different continuous, visually fluid landscape.

Preferably, the playing structure modules are formed in sets with each set depicting a unique setting. It is also preferred that the topography on the reversible tops of the playing structure modules in each set are configured to permit identical sets of playing structure modules to be arranged in larger arrays while still providing a continuous, visually fluid landscape. It is also preferred that the topographies on the tops of the playing structure modules in each set are configured to permit different sets of playing structure modules to be arranged in larger arrays while still providing a continuous, visually fluid landscape.

Preferably, the playing structure modules are stackable when separated from other playing structure modules in the playing structure to facilitate cleaning and storage. It is also preferred that the playing structure modules are stackable to create three dimensional playing structures. In this instance, it is preferred that at least some of the playing structure modules have a secondary playing structure below the reversible top and that at least some of the reversible tops provide access to the secondary playing surfaces via passages formed therethrough. This permits underwater and/or underground landscapes to be created. Preferably, the playing structure modules stacked on top of other playing structure modules are open on their sides to provide free access to the reversible tops on the playing structure modules below them.

The present invention provides advantages in that the reversible top of each playing structure module allows different landscapes to be created while maintaining the visual fluidity of the overall landscape of the playing structure. Also, because the playing structure modules can be interlocked with other playing structure modules, different size landscapes can be created making the variety and size of created landscapes virtually limitless. Because of this, the present invention forms a stage which provides direction and focus for a child's imagination. Also, because the playing surfaces of the playing structure are raised from the ground, the playing surfaces are at a convenient physical height for most children. More importantly, the toys placed on the playing structure are raised so that the child's point of view is as if he or she is among them.

In addition, the present invention provides further advantages in that children's toys remain on the playing structure and may be stored on the playing surface or on the storage shelf when the child is finished playing. This avoids the problem associated with children spreading their toys around the household and speeds up the cleaning process significantly. Also, the design of the playing structure modules allows the modules to be stacked facilitating compact storage and house cleaning.

BRIEF DESCRIPTION OF THE DRAWINGS

Embodiments of the present invention will now be described more fully with reference to the accompanying drawings in which.

DESCRIPTION OF THE PREFERRED EMBODIMENTS

Figure 1:
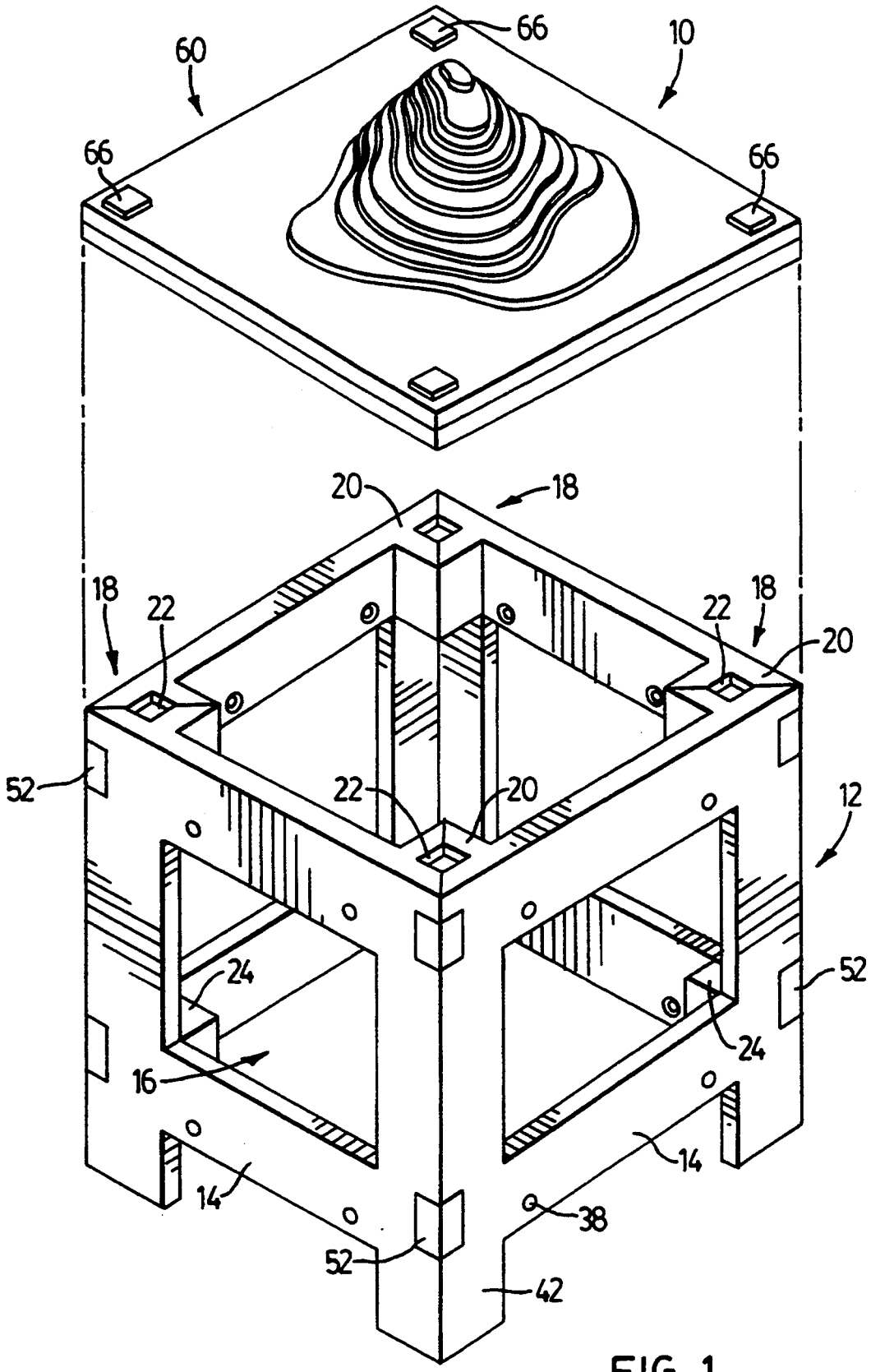
FIG. 1 is a perspective view of a playing surface module with its playing surface element lifted therefrom.

Referring now to FIG. 1, a playing structure module is shown and is generally indicated by reference numeral 10. The module 10 includes a box-like frame 12 constituted by four interlocking frame elements 14 having an open interior to define a storage space 16. At the four corners of the frame 12 adjacent its top are square supports 18. The upper surfaces 20 of the supports 18 have square recesses 22 formed in them. Similar square supports 24 are located at the corners of the frame 12 intermediate the top and bottom thereof with the supports 24 being located nearer the bottom of the frame 12. The supports 24 do not have recesses formed in them but support a storage shelf 26 (see FIG. 5).

Figure 2:
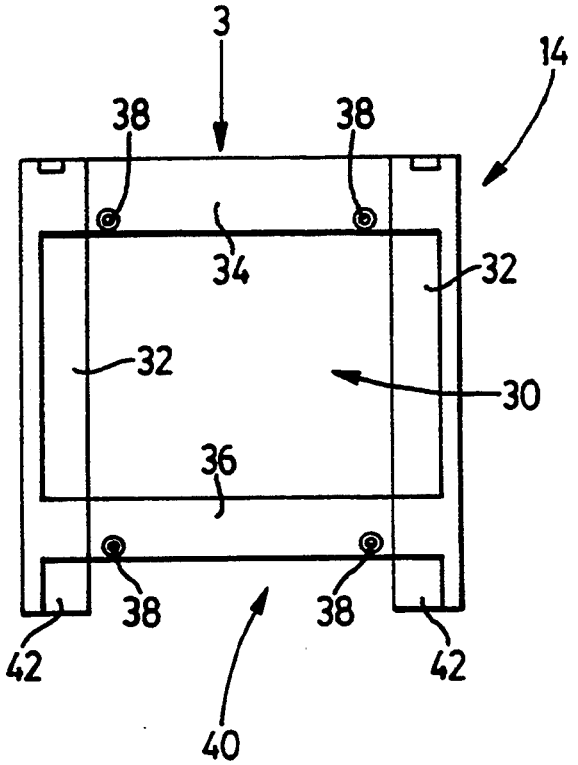
FIG. 2 is a side elevation view of a frame element of the module of FIG. 1.
Figure 3:
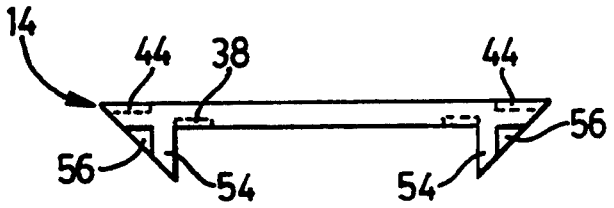
FIG. 3 is a top plan view of the frame element shown in FIG. 2.

Referring now to FIGS. 2 and 3, one of the frame elements 14 is better illustrated although it should be apparent that all of the frame elements 14 of the frame 12 are identical. As can be seen, each frame element 14 is rectangular when viewed from the side and has a centrally located, rectangular aperture 30 formed through it to define a pair of laterally spaced, upstanding side panels 32 bridged by vertically spaced, horizontal, upper and lower panels 34 and 36 respectively. Holes 38 are provided through the upper and lower panels 34, 36 respectively at spaced locations. A rectangular notch 40 is formed in the frame element 14 below the lower panel 36 to define a pair of legs 42.

Figure 4:
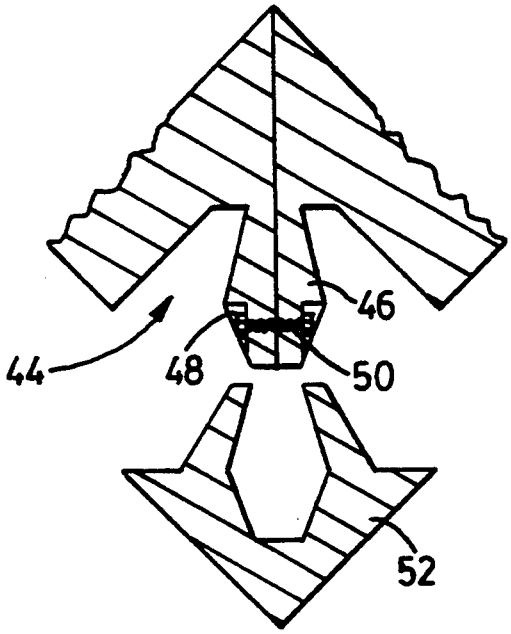
FIG. 4 is a sectional view of a portion of the playing structure module shown in FIG. 1.

Vertically spaced notches 44 are formed in the side panels 32 adjacent the outer edges thereof (see FIGS. 3 and 4). The notches 44 align with the notches 44 formed in adjacent frame elements 14 when the frame elements 14 are assembled to form the frame 12. The notches 44 are shaped to define projections 46 at the corners of the frame 12. The projections 46 have holes 48 provided through them which align with the holes 48 formed in the projections 46 of the adjacent frame elements 14 when the frame elements 14 are assembled to form the frame 12. A fastener 50 passes through the holes 48 to secure the frame elements 14 together at right angles to one another. The notches 44 receive plastic clips 52 which snap over projections 46 and cover the notches 44.

Triangular projections 54 extend from the side panels 32 just below the bottom edge of the aperture 30 and at the top thereof and constitute one half of the supports 24 and 18 respectively. The projections 54 at the top of the side panels 32 have triangular recesses 56 formed in them and constitute one-half of the recesses 22.

Removably supported on the frame 12 is a reversible top 60 having playing surfaces 62, 64 on its opposed major sides. On each playing surface near its four corners are square projections 66 sized to be received in the apertures 22 to inhibit the top 60 from sliding when properly positioned on the frame 12. Each playing surface 62, 64 includes a multi-coloured, three-dimensional, topographic scene thereon. The topographic scenes are suggestive of a predetermined landscape but are not too specific allowing children to get more variety since they can easily redefine the landscapes for their own imaginative purposes. The topography on each playing surface 62, 64 is also stepped to provide generally planar, horizontal surfaces at different elevations and to minimize inclined surfaces. This provides playing platforms for miniature people, animals and vehicles used during a child's play.

The topographic scene on each playing surface 62, 64 is different although they are basically complimentary in configuration. For example, the playing surface 62 has a landscape on it which resembles a mountain. On the opposite playing surface 64 which is unseen in FIG. 1 but which can be seen in FIG. 5, the landscape of the topographic scene resembles an open-pit mine. Other tops 60 may, for example, have ancient ruins on one playing surface 62 and a mountainous road on the opposite playing surface 64.

Figures 5, 6:
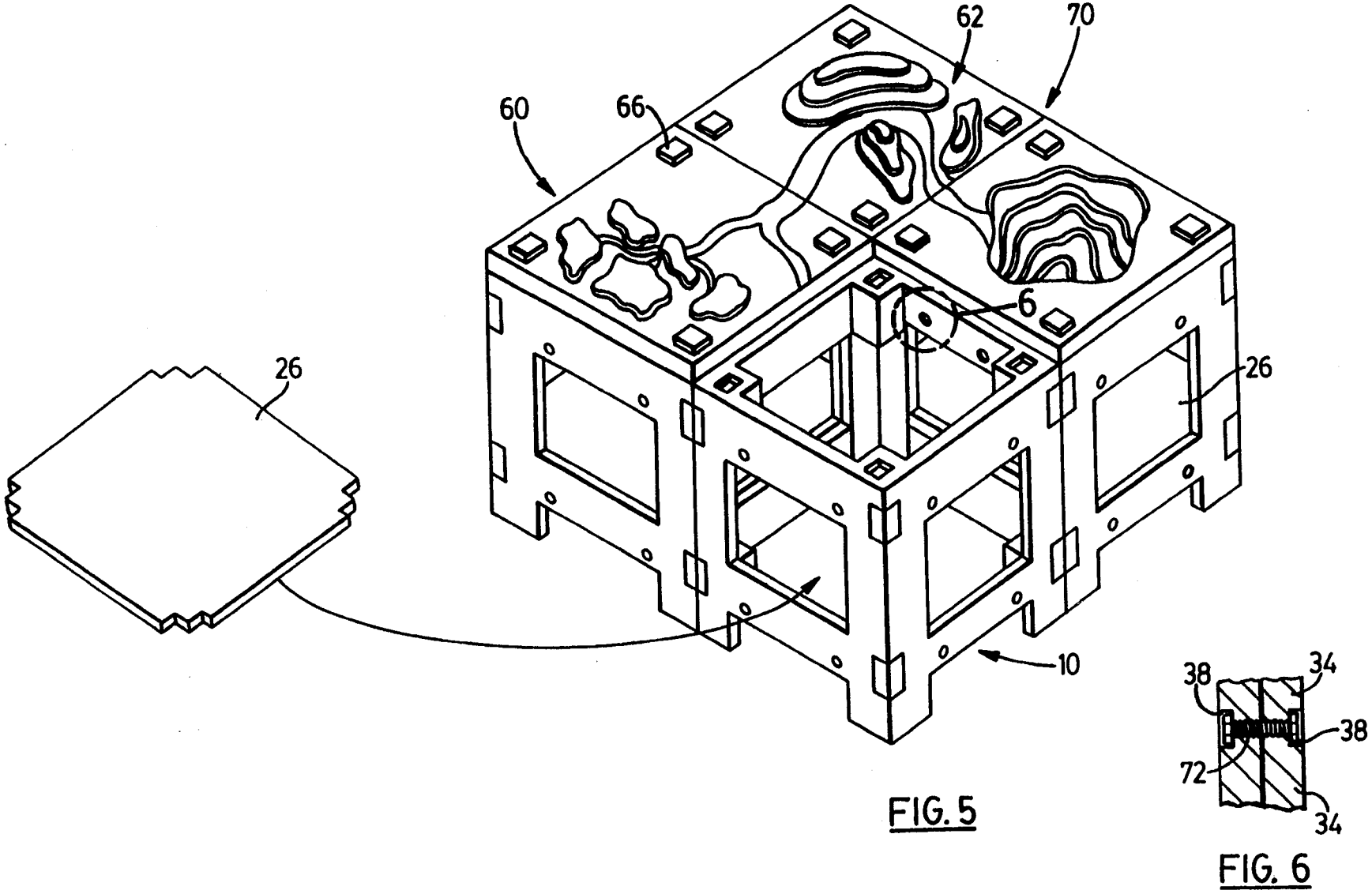
FIG. 5 is a perspective view of a playing structure formed from a plurality of playing structure modules of the type shown in FIG. 1.
FIG. 6 is a sectional view of a portion of the playing structure shown in FIG. 5.

The landscape and colouring of the playing surfaces 62, 64 of one top 60 are designed to interact with the playing surfaces 62, 64 of other tops on other playing structure modules 10. FIG. 5 shows a playing structure 70 formed from a plurality of playing structure modules 10 arranged to form an array. When the playing structure modules are arranged in this manner, the holes 38 in the upper and lower panels 34 and 36 respectively of adjacent playing structure modules 10 align. Fasteners 72 are passed through the aligned holes 38 in adjacent panels to secure the playing structure modules 10 and prevent relative movement between them (see FIG. 6).

To permit many different playing structure landscapes to be created, the playing structure modules 10 are made in sets with, in this example, each set including six playing structure modules 10. The sets of playing structure modules 10 have different topography designs on their tops 60 and represent different worlds. Therefore, one set of playing structure modules may represent for example, an "Ancient World" while other sets may represent a "Dinosaur World" and a "City World" respectively.

Figure 7:
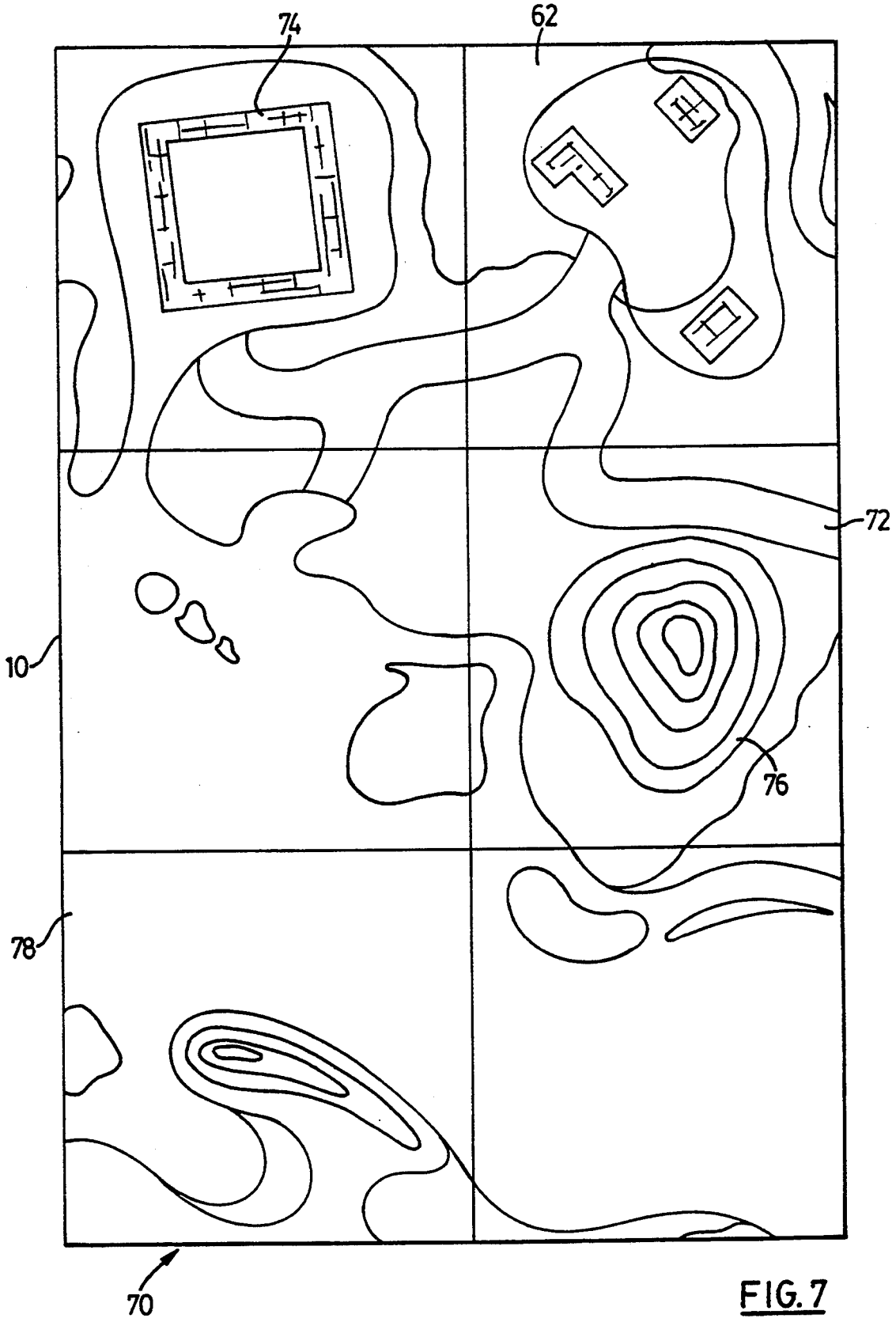
FIG. 7 is a top plan view of a playing structure formed from an array of six playing structure modules.

FIG. 7 shows one set of playing structure modules 10 interconnected in a 3×2 array to form a playing structure 70 having a visually fluid, continuous landscape. The landscape includes a road 72 which winds across four of the playing surfaces 62. A platform 74 surrounded by water on one of the playing surfaces provides an ideal location for a toy castle surrounded by a moat. A mountain 76 is also provided on one playing surface 62 while a continuous waterway 78 extends across five of the six playing surfaces 62 in the set.

Figure 9A:
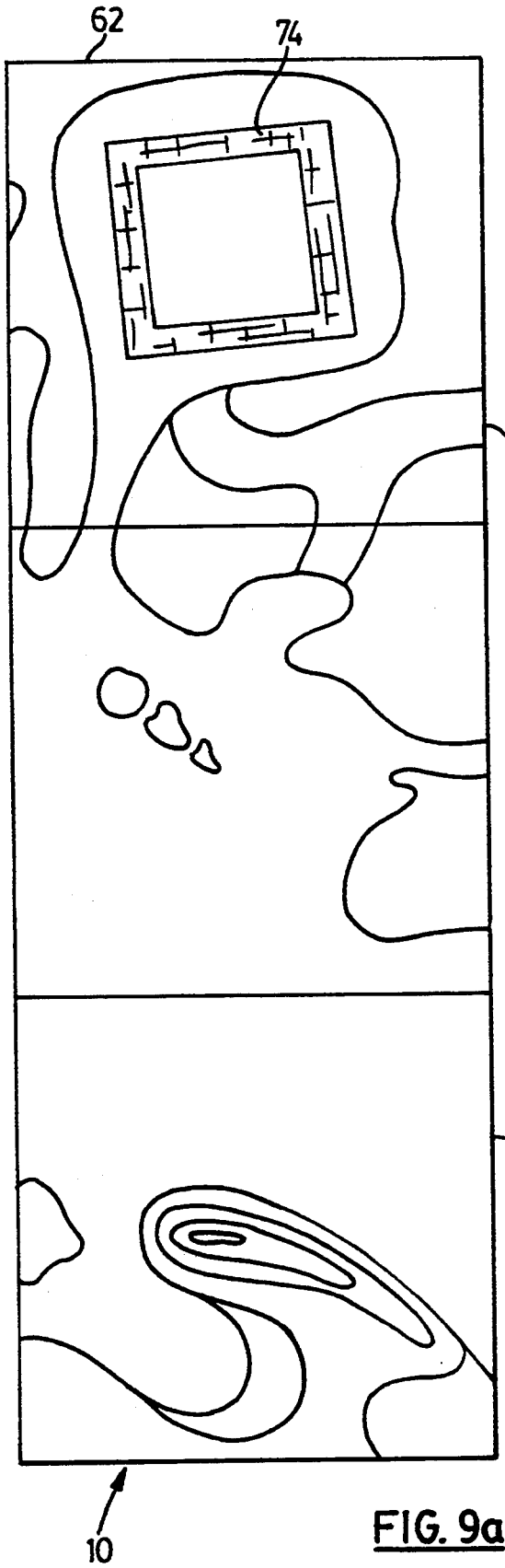
FIG. 9*a* is a top plan view of one column of the array of playing structure modules illustrated in FIG. 7.
Figure 9B:
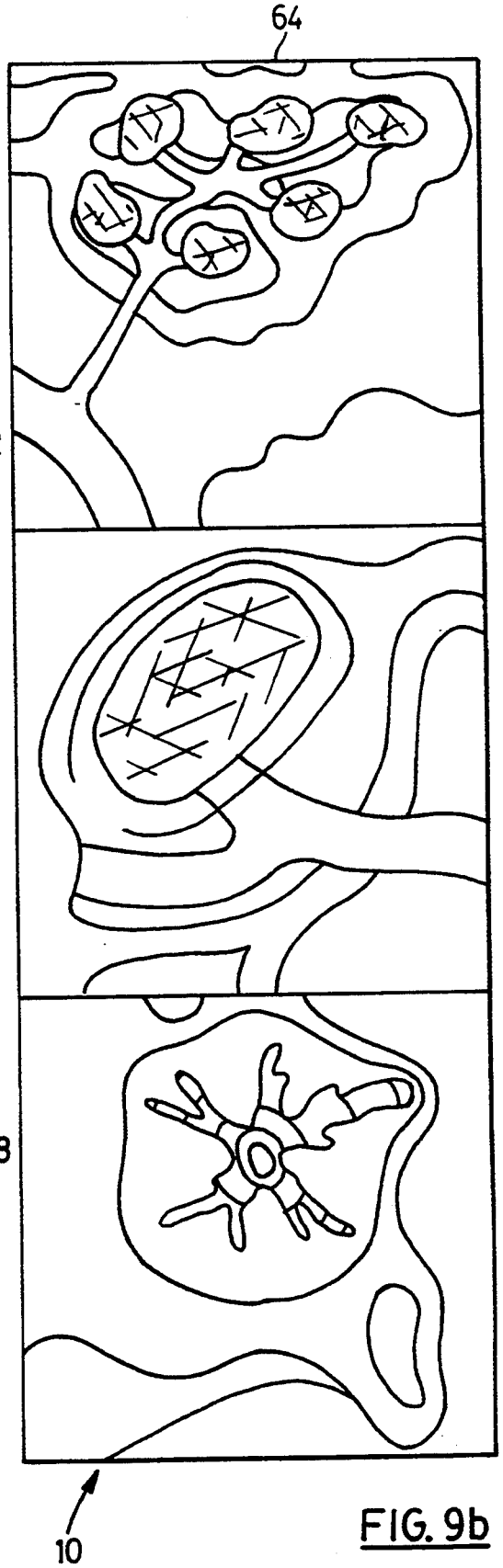
FIG. 9*b* is a bottom plan view of the tops of the playing structure modules shown in FIG. 9*a;*
Figure 10A:
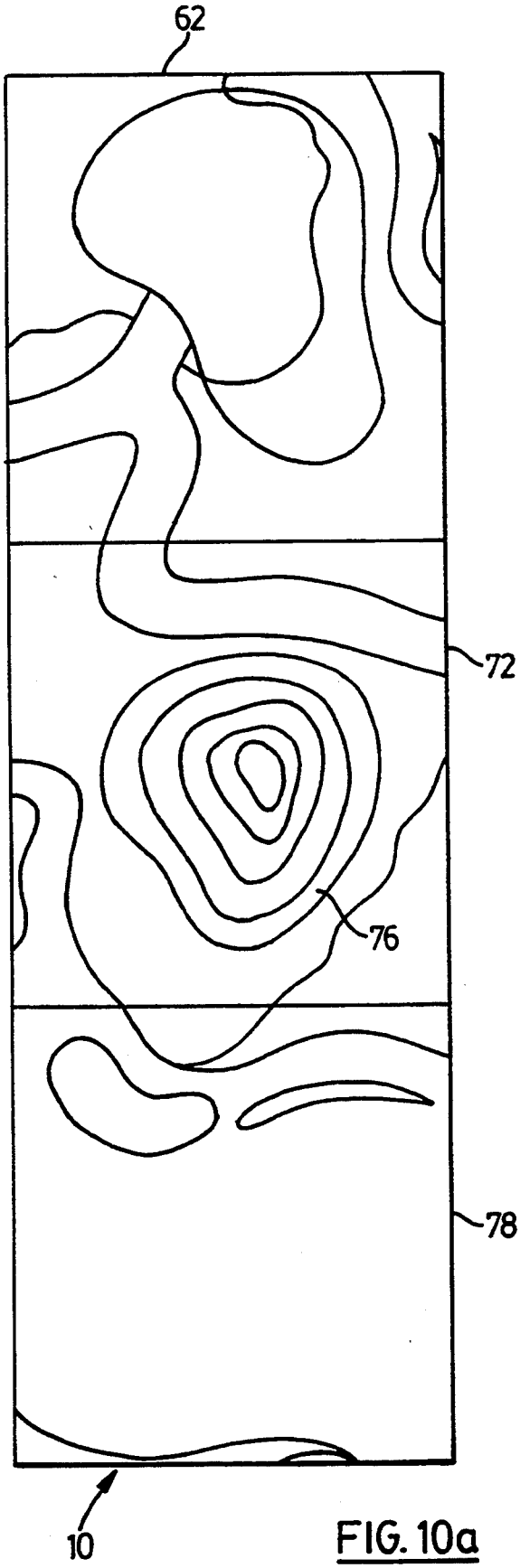
FIG. 10*a* is a top plan view of the other column of the array of playing structure modules illustrated in FIG. 7.
Figure 10B:
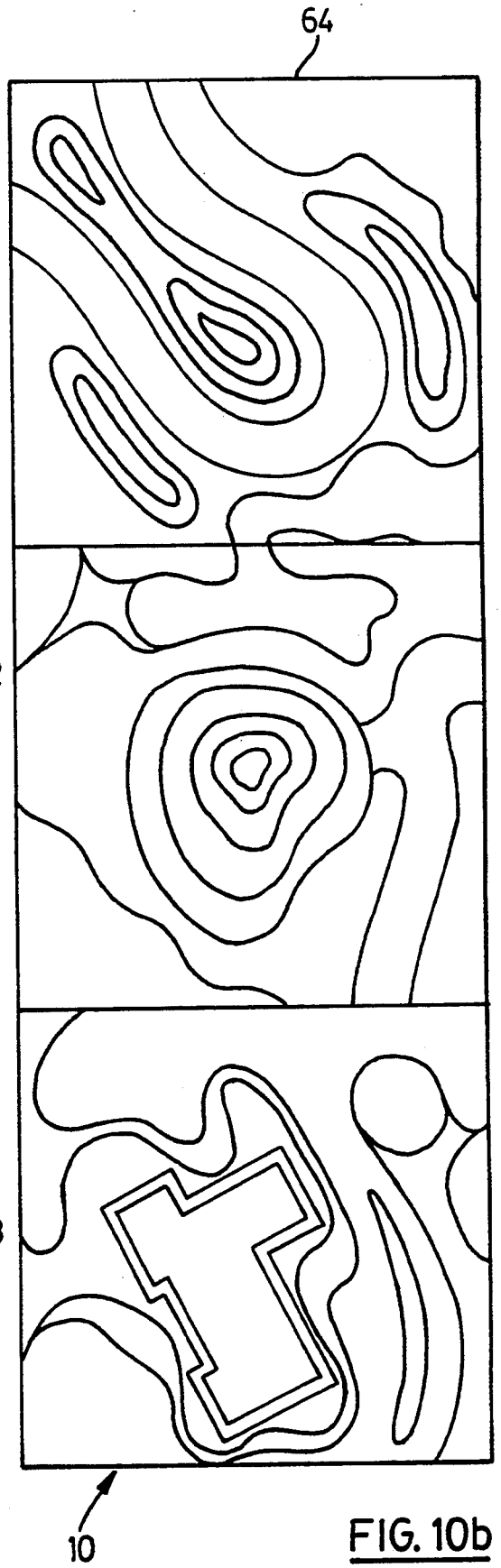
FIG. 10*b* is a bottom plan view of the tops of the playing structure modules shown in FIG. 10*a;*

FIG. 9*a* shows the playing structure modules 10 forming the first column of the array in FIG. 7 while FIG. 9*b* shows the playing surfaces 64 of the tops 60 of those same playing structure modules 10 which face the shelf 26 and remain unseen. Similarly, FIG. 10*a* shows the playing structure modules 10 forming the second column of the array in FIG. 7 while FIG. 10*b* shows the playing surfaces 64 of the tops 60 of those same playing structure modules 10 which face the shelf 26 and remain unseen.

Figure 12:
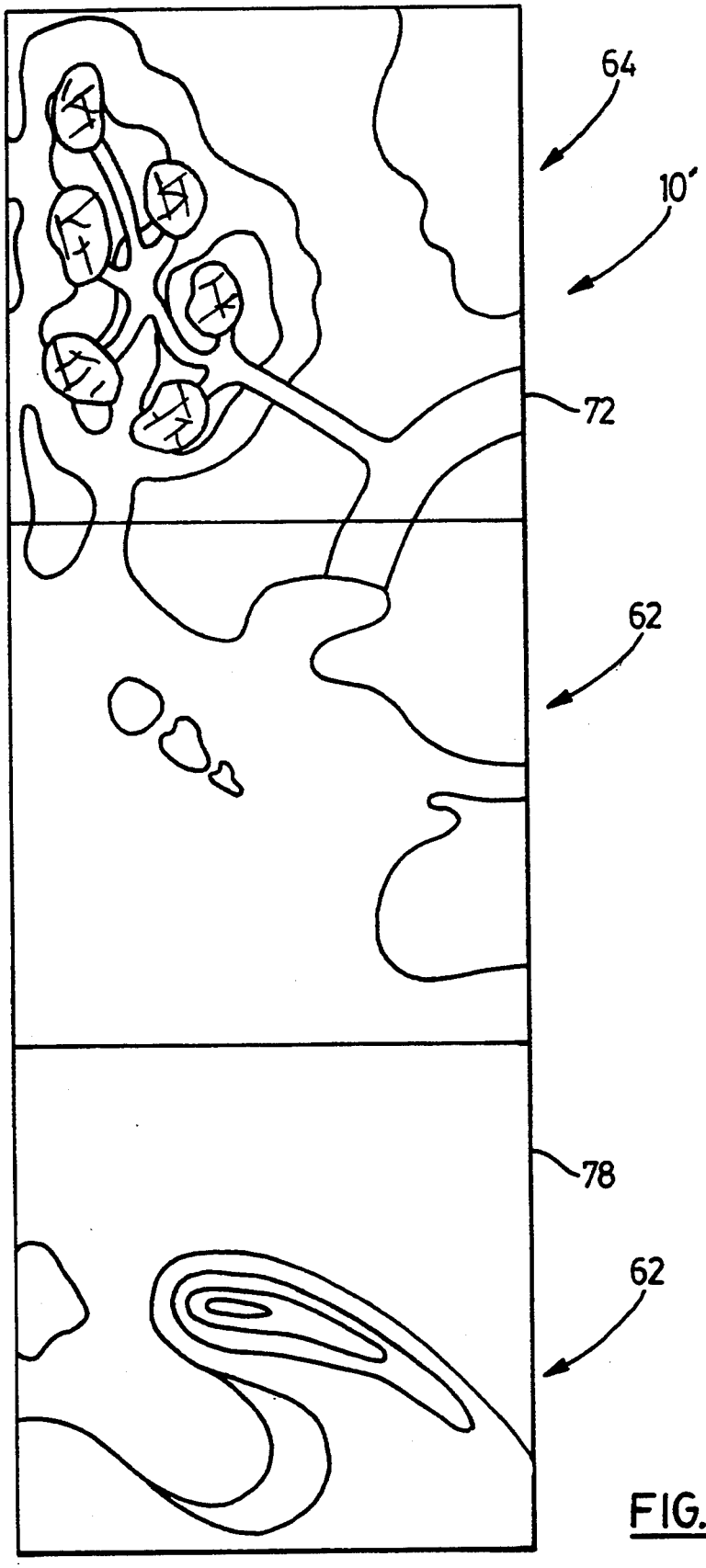
FIG. 12 is a top plan view of the one column illustrated in FIG. 9*a* with the top of one of the playing structure modules flipped and rotated in the manner shown in FIGS. 11*b* and 11*c* respectively.

The topographic scene on each playing surface of the playing surface modules 10 in each set is designed to exhibit a certain symmetry so that different continuous, visually fluid landscapes can be formed. In fact with a set of six playing structure modules 10, sixty-four different visually fluid landscapes can be created. FIG. 12 shows a top plan view of the column of playing structure modules 10 illustrated in FIG. 9a with the top 60 of the uppermost playing structure module 10' reversed along a North-West, South-East diagonal. As can be seen, the resulting landscape of the three playing structure modules in the column 10 is still continuous and visually fluid although the castle platform 74 has been replaced by roads and bridges 80 which extend to islands and terminate at smaller platforms 82.

Figure 11A:
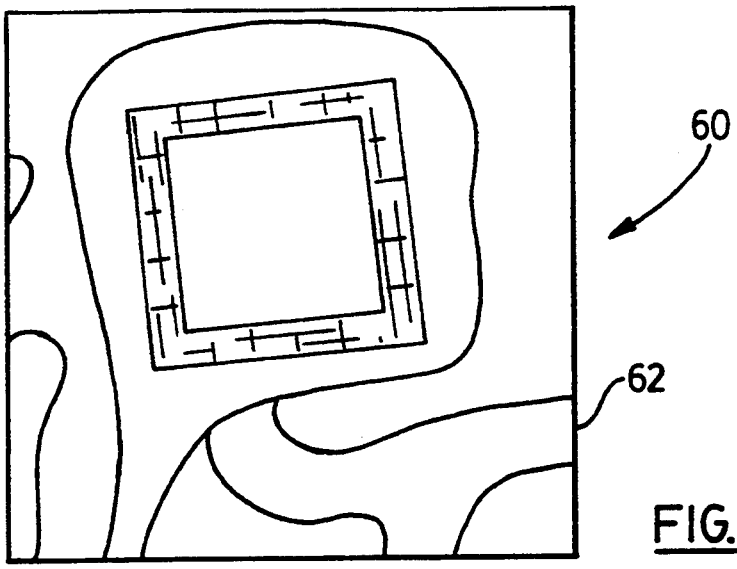
FIGS. 11*a*, 11*b* and 11*c* show top plan views of one of the tops of a playing structure module forming part of the playing structure of FIG. 7 in a first condition, flipped over along an east-west axis and rotated counterclockwise by 90° respectively.
Figure 11B:
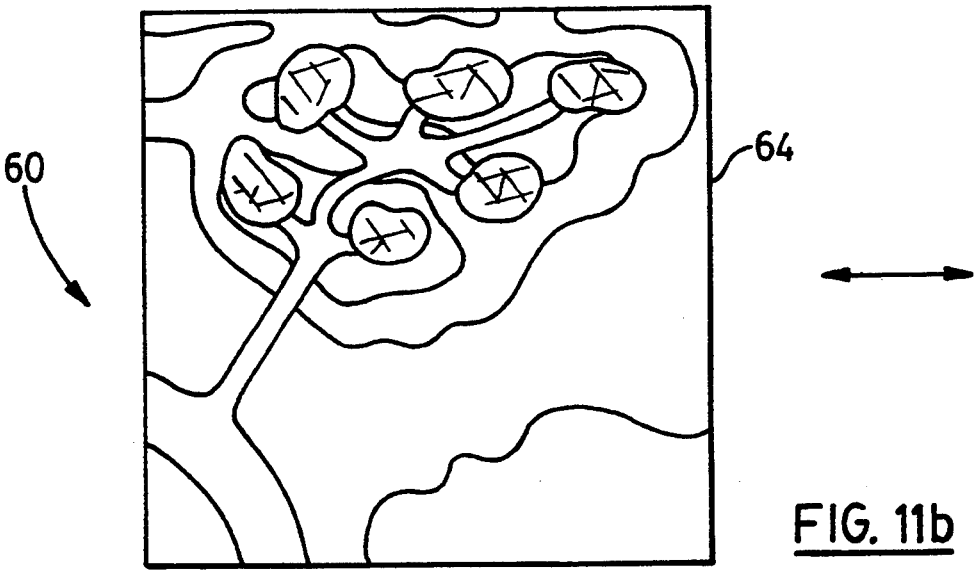
Figure 11C:
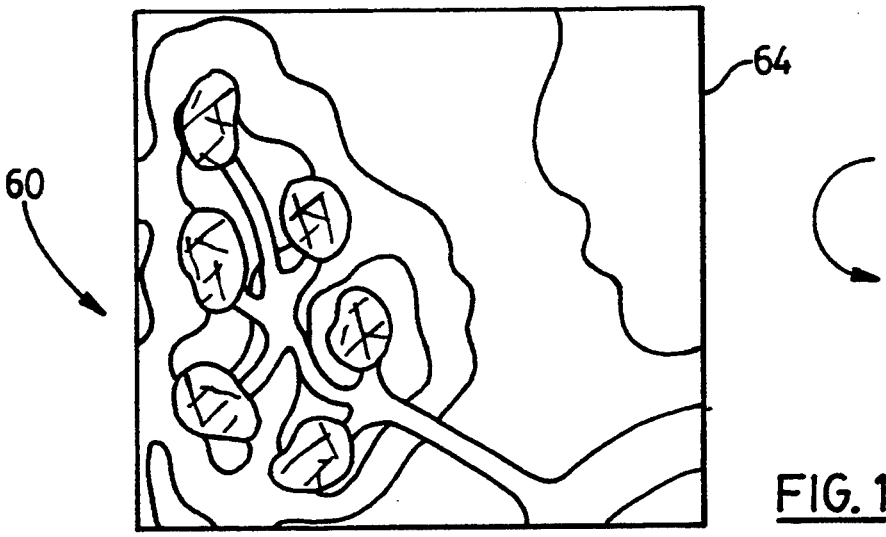

FIGS. 11*a*, 11*b* and 11*c* show the manner in which the top 60 of the playing structure module 10' is moved to create the landscape illustrated in FIG. 12. In particular, when changing the playing structure module from that shown in FIG. 9*a* to that shown in FIG. 12, the top 60 of the playing structure module 10' simply needs to be reversed along the North-West, South-East diagonal. This movement of the top is broken down into its constituents in FIGS. 11*b* and 11*c*. Once the top 60 has been reversed along its diagonal, the top 60 can be placed on the frame 12 of the playing structure module 10' and the landscape will still be visually fluid.

Figure 8:
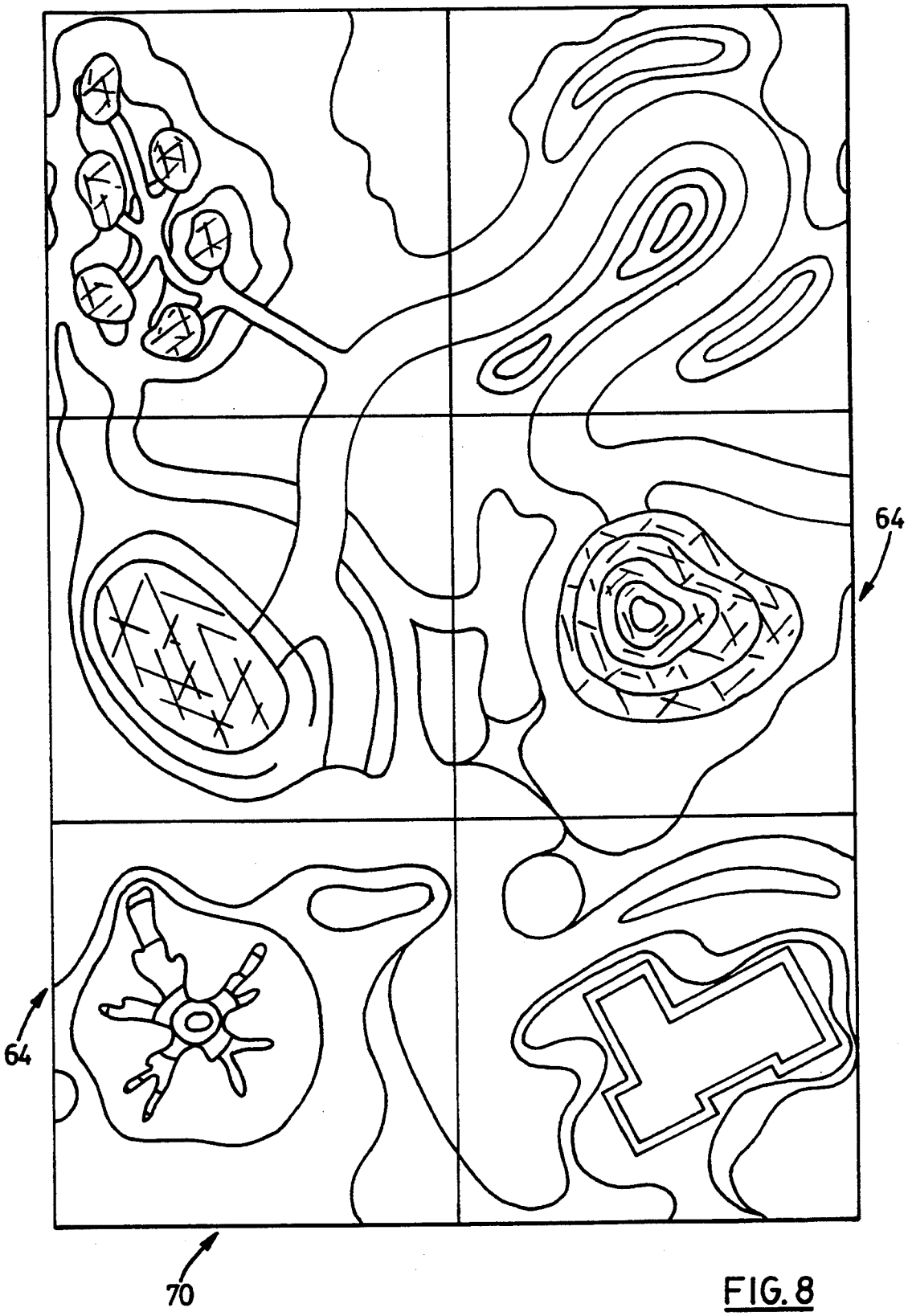
FIG. 8 is a top plan view of the playing structure shown in FIG. 7 with the tops of all of the playing structure modules reversed and rotated.
Figure 13:
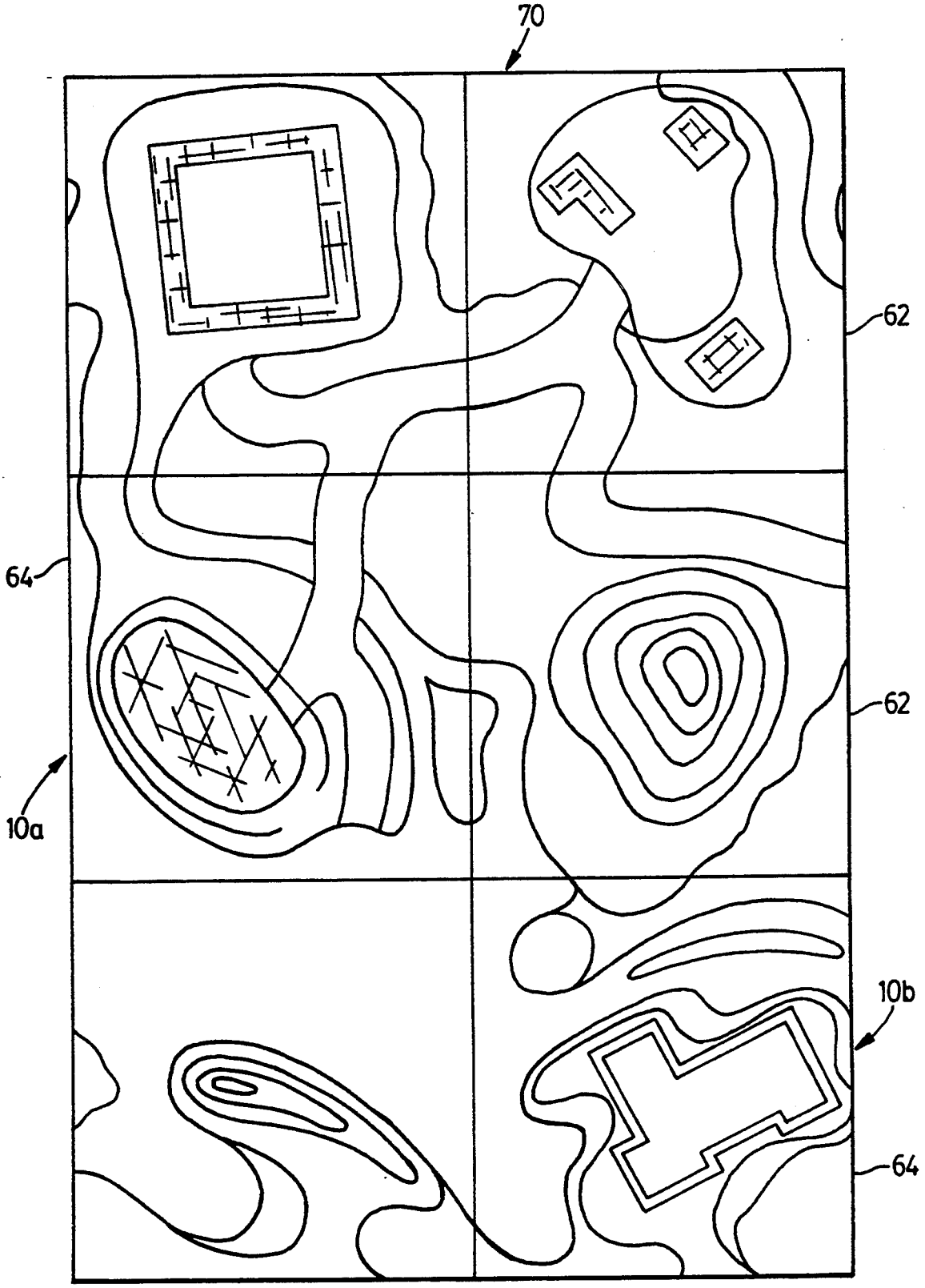
FIG. 13 is a top plan view of the playing structure of FIG. 7 with the tops of two playing structure modules flipped and rotated in the manner shown in FIGS. 11*b* and 11*c* respectively.

FIG. 13 is a top plan view of the playing structure 70 shown in FIG. 7 with the tops 60 of the playing structure modules 10*a* and 10*b* reversed along their North-West, South-East diagonal. FIG. 8 on the other hand shows the playing structure 70 of FIG. 7 with the tops 60 of all of the playing structure modules 10 reversed along their North-West, South-East diagonal.

Figure 14:
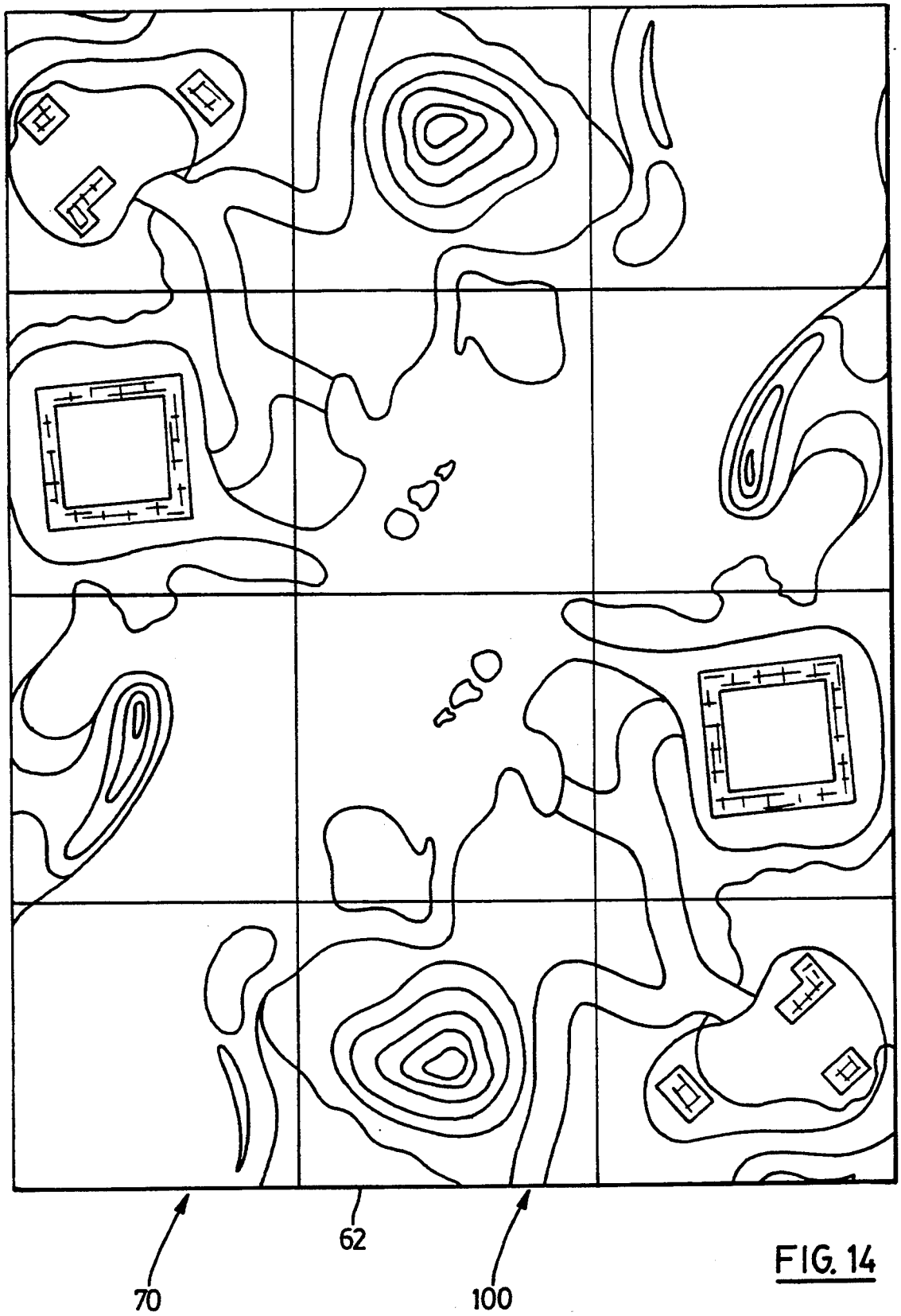
FIG. 14 is a top plan view of a playing structure formed from two interconnected arrays of playing structures similar to those shown in FIG. 7.

The landscapes depicted on the playing surfaces 62, 64 of the playing surface modules 10 in each set are also designed so that continuous, visually fluid landscapes can be created by interconnecting two or more sets of playing structure modules 10. FIG. 14 shows a top plan view of two identical sets of playing structure modules 10 (the same as the set shown in FIG. 7) interconnected to form a larger playing structure 100 while still depicting a continuous, visually fluid landscape. As can be seen, to create this landscape, one set of playing structure modules 10 has been rotated 180°. It should be apparent that the tops 60 of any one of playing structure modules 10 forming the playing structure 100 may be reversed along a diagonal in the manner described previously, to create a new continuous and visually fluid landscape. This allows a significant number of different landscapes to be created and with the addition of more playing structure modules 10 or sets thereof, the variation of potential landscapes is virtually limitless.

In use, the various playing structure modules 10 in the set simply need to be arranged within the room in which they are located to form a playing structure having the desired configuration. The fasteners 72 can then be passed through the holes 38 to secure adjacent playing structure modules. The tops 60 of the modules can then be arranged to create a continuous, visually fluid landscape by lifting the tops 60 from the frames 12 and reversing them along a diagonal as desired. Once one continuous, visually fluid landscape has been created, others are possible by reversing any one of tops 60 along a North-West, South-East diagonal. The design of the tops 60 facilitate the creation of different landscapes by children using the playing structure.

Once created, toys can be placed on the playing surfaces and moved as desired. The varying three-dimensional topography of the individual playing surfaces 62, 64 respectively provides a stage which promotes a child's imagination and entertains them for extended periods of time. When the child is finished playing with the playing structure, the toys can be removed from the playing surfaces and stored on the shelf 26 of one or more playing structure modules. If necessary, after a child is finished playing and the toys are stored on a shelf or shelves 26, the playing structure 70 can be disassembled into its individual modules 10 and stacked in a convenient location out of the way. This of course facilitates the cleaning process.

Figure 15:
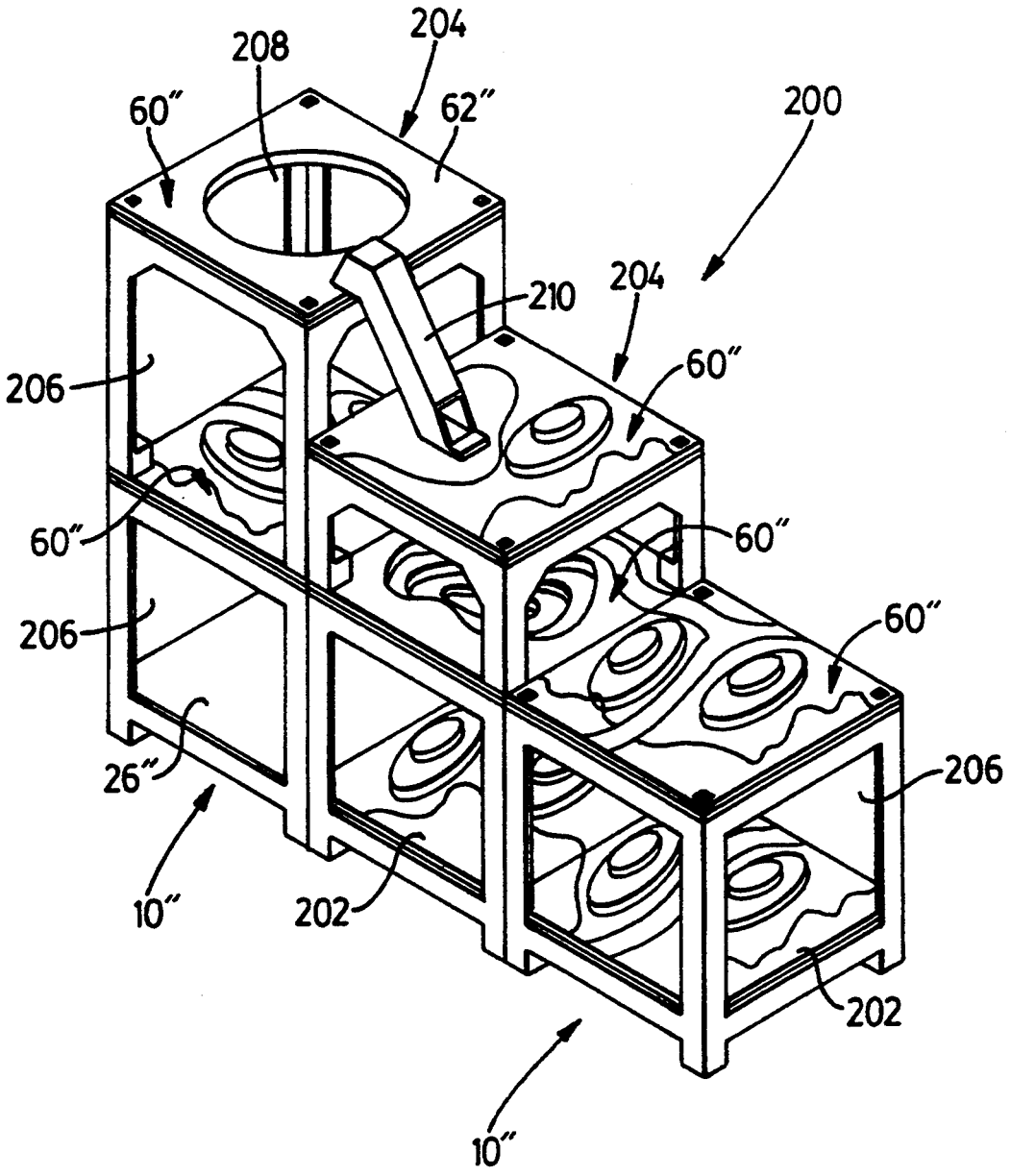
FIG. 15 is a perspective view of another embodiment of a playing structure formed from a plurality of playing structure modules.

Referring now to FIG. 15, an alternative embodiment of an array 200 of playing structure modules is shown. In this embodiment, like reference numerals will be used to indicate like components with a "′′′′" added for clarity. As can been seen, the playing structure modules 10″ are stacked not for the purpose of storage, but rather to create a three dimensional playing structure. The lower playing structure modules 10″ in the array are basically the same as that shown in FIG. 1. However, on some of the modules 10″ in the array 200, the shelf 26″ has been replaced with a playing surface 202. Similar to the playing surfaces 62 and 64, the playing surface 202 has a three dimensional topography on it which can be arranged to create a visually fluid topographic scene with the playing surfaces 202 on adjacent playing structure modules 10″. The playing surface 202 may also be reversible to allow the topography constituted by the playing surfaces 202 to be varied.

On top of at least some of the playing structure modules 10″ are other playing structure modules 204 having a slightly different design. The modules 204 are open on their sides and do not include a shelf. Therefore, when the playing structure modules 204 are placed on top of another module 10″ or 204, the reversible top 60″ on that module is exposed. The modules 204 also have formations on the bottom of their legs which are complimentary to the formations at the corners of the reversible tops 60″ to inhibit lateral movement between stacked modules. The modules 204 may also come in different heights to provide a stepped playing surface as illustrated. Side panels 206 may be attached to the sides of one or more of the modules 10″ and 204″.

When creating a three dimensional playing structure 200, the playing surfaces 62″, 64″ of the reversible tops 60″ on at least some of the playing structure modules 204 are provided with ladders, trap doors and the like to provide access to the playing surfaces on the playing structure modules below them. For example, in FIG. 15, one of the playing structure modules 204 has a passage 208 formed in its playing surface 62″. A slide 210 extends between the different height modules 204. Although not shown, passages, trap doors and the like may be formed in the playing surfaces of any of the modules 10″ and 204 respectively. This arrangement of playing structure modules allows alternative themes to be created. In particular, the playing surfaces 202 and the playing surfaces on the reversible tops 60″ of modules 10″ on which a module 204 is located, can be designed to have an underground or underwater theme with the playing surfaces of the uppermost playing structure modules having a ground or sea level theme thereon. If side panels 206 are used, they can be colored to suit the theme of the playing structure 200.

Figure 16:
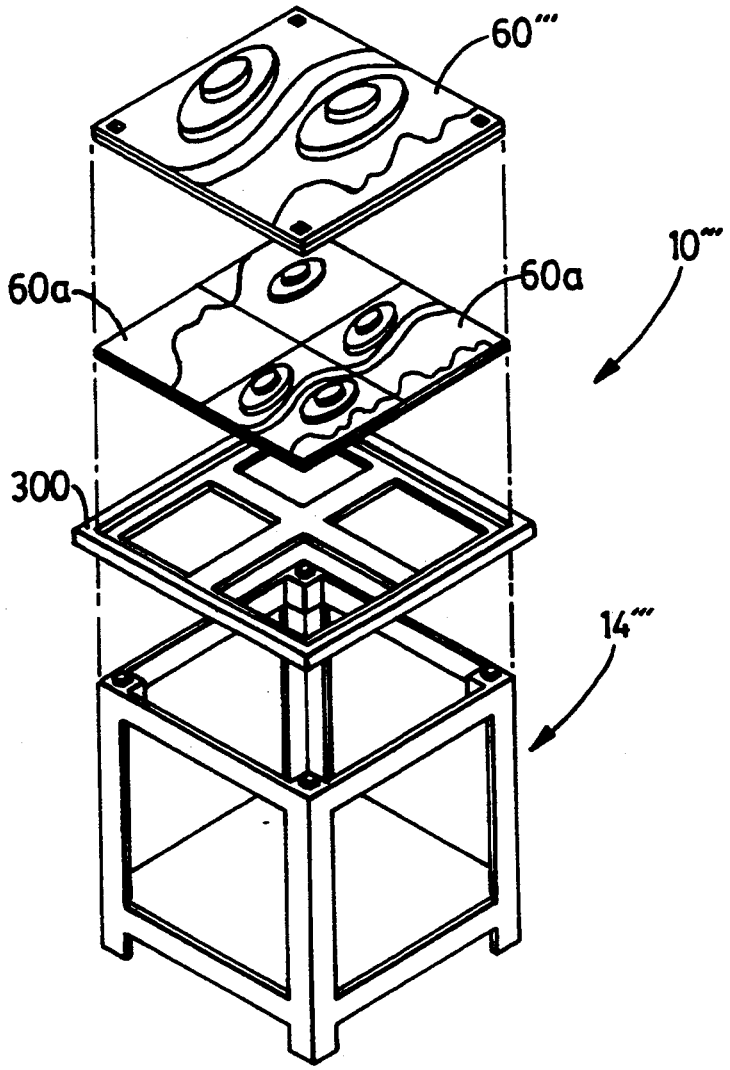
FIG. 16 is an exploded perspective view of another embodiment of a playing structure module.

Referring now to FIG. 16, yet another embodiment of a playing structure module is shown. In this embodiment, like reference numerals will be used to indicate like components with a "′′′′" added for clarity. The playing structure module 10‴ has a reversible top 60‴ formed of smaller, reversible top elements **60*a*. Each top element 60*a* has a playing surface on both of its major sides. The reversible top elements 60*a* can be re-arranged in the same manner as the reversible tops 60 to create different three dimensional topographies on a single playing structure module 10‴ of a smaller scale then those of the previous embodiments. When using the top elements 60*a* to form a playing surface on the module, a retention frame 300 is interposed between frame 14″** and the top elements.

It has been found that the topography of the playing structure in combination with the toys a children places thereon suggests directions and presents tensions which children quickly absorb into their play. Also, the playing structure changes when different toys are placed on it and are utilized differently by different children. Not only is the present invention versatile in the sense that the playing surface of the playing structure can be changed but also in that the playing surface of the playing structure changes depending on the types of toys used on it.

Although the frame of the playing structure module has been described as including four rectangular, interconnected frame elements, it should be apparent to one of skill in the art that various frame designs can be used to support the top above the ground while allowing the top to be reversed to change the playing surface. It should also be realized that playing structure modules having reversible tops of different geometric shapes can be provided while ensuring that the topographic design on the playing surfaces of the tops permit playing structures to be placed side by side with the playing surfaces on adjacent playing structures creating a continuous, visually fluid landscape.

We claim:

1. A playing structure comprising:

a plurality of playing structure modules arranged in an array, each of said playing structure modules including a support and a reversible top on said support, said support supporting said reversible top above the surface on which said support is located, said reversible top having a pair of opposed playing surfaces, the opposed playing surfaces depicting different landscapes, the reversible tops being first arrangeable such that the landscape over adjacent playing surfaces is visually fluid, the landscape on each opposed playing surface of at least one playing structure module having less than four-fold symmetry such that the landscape is visually fluid over adjacent playing surfaces when the reversible top of said at least one playing structure module is reversed about a module diagonal line.

2. A playing structure as defined in claim 1 wherein at least one of the opposed playing surfaces on at least one reversible top has a three-dimensional topography.

3. A playing structure as defined in claim 2 wherein said three-dimensional topography includes at least one formation on a portion of said opposed playing surface and spaced from the side edges thereof, said at least one formation having a stepped profile so that said three-dimensional topography provides generally planar, horizontal surfaces at at least two different elevations, said planar surfaces constituting support platforms for toys.

4. A playing structure as defined in claim 3 wherein at least one opposed playing surface on a plurality of reversible tops has a three-dimensional topography.

5. A structure according to claim 1, wherein said playing structure modules are formed in sets with each set depicting a unique setting.

6. A structure according to claim 5, wherein the landscapes on the reversible tops of the playing structure modules in each set are configured to permit identical sets of playing structure modules to be arranged in larger arrays while still providing a continuous, visually fluid landscape.

7. A structure according to claim 1, wherein the support of each playing structure module is in the form of a frame having an open interior, the frames of at least one of said playing structure modules supporting a secondary surface below said reversible top.

8. A structure according to claim 7, wherein said secondary surface has a three dimensional topography to constitute a secondary playing surface.

9. A structure according to claim 8, wherein playing structure modules are stackable to create three-dimensional arrays, and wherein playing structure modules placed vertically on top of other playing structure modules provide access to the reversible tops of the playing structure modules below them.

10. A structure according to claim 7, further including sidewalls on selected sides of at least some of said frames, said sidewalls presenting an interior surface of graphics thereon consistent with said secondary playing surface.

11. A playing structure comprising:

a plurality of playing structure modules arranged in an array, each of said playing structure modules including a support and a reversible top on said support, said support supporting said reversible top above the surface on which said support is located, said reversible top having a pair of opposed playing surfaces, the opposed playing surfaces depicting different landscapes, the landscape on each playing surface having less than four-fold symmetry and said reversible top being arrangeable such that the landscape is visually fluid over adjacent playing surfaces and when any one or all of said reversible tops are reversed about a module diagonal line, at least one of the opposed playing surfaces on at least one reversible top having a three-dimensional topography, said three-dimensional topography including at least one formation on a portion of said playing surface and spaced from the side edges thereof, said at least one formation having a stepped profile so that said three-dimensional topography provides generally planar, horizontal surfaces at at least two different elevations, said planar surfaces constituting support platforms for toys.

12. A playing structure as defined in claim 11 wherein said playing structure modules are formed in sets with each set depicting a unique setting.

13. A playing structure as defined in claim 12 wherein the landscapes on the reversible tops of the playing structure modules in each set are configured to permit identical sets of playing structure modules to be arranged in larger arrays while still providing a continuous, visually fluid landscape.

14. A playing structure as defined in claim 13 wherein the landscapes on the reversible tops of the playing structure modules in each set are configured to permit different sets of playing structure modules to be arranged in larger arrays while providing a continuous, visually fluid landscape.

15. A playing structure as defined in claim 14 wherein the landscapes on said reversible tops are configured such that when said playing structure modules are arranged to provide a continuous, visually fluid landscape, said reversible tops must be reversed along a diagonal to create a different continuous, visually fluid landscape.

16. A playing structure as defined in claim 11 wherein the support of each playing structure module is in the form of a frame having an open interior, the frame of at least one of said playing structure modules supporting a secondary surface below said reversible top.

17. A playing structure as defined in claim 16 wherein said secondary surface constitutes a storage shelf.

18. A playing structure as defined in claim 16 wherein said secondary surface has a three dimensional topography to constitute a secondary playing surface.

19. A playing structure as defined in claim 18 wherein at least one reversible top has at least one passage therethrough to permit access to said secondary playing surface.

20. A playing structure as defined in claim 19 wherein said playing structure modules are stackable.

21. A playing structure as defined in claim 20 wherein said playing structure modules are stackable to create three-dimensional arrays and wherein playing structure modules placed vertically on top of other playing structure modules provide access to the reversible tops of the playing structure modules below them.

22. A playing structure as defined in claim 11 wherein said playing structure modules are releasably connectable to each other to form said array, said playing structure modules being arrangeable in arrays of varying configurations to allow different shaped playing surfaces to be created all with continuous, visually fluid landscapes.

23. A playing structure as defined in claim 11 wherein the opposed playing surfaces on at least one reversible top have different three-dimensional topographies.

24. A playing structure as defined in claim 11 wherein the reversible tops of a plurality of playing structure modules have at least one opposed playing surface with a three-dimensional topography thereon.

25. A playing structure as defined in claim 16 wherein at least one reversible top has at least one passage therethrough to permit access to said secondary surface.

26. A playing structure module comprising:

a reversible top including a pair of opposed playing surfaces, each of said opposed playing surfaces depicting a different landscape, at least one of said opposed playing surfaces having a three-dimensional topography; and a frame to space vertically said reversible top from the surface on which said frame is located, said frame having an open interior and supporting below said reversible top, a secondary playing surface having a landscape thereon, said reversible top further including at least one passage therethrough to permit access to said secondary playing surface through said reversible top.

27. A playing structure module as defined in claim 26 wherein said secondary playing surface has a three-dimensional topography.

28. A playing structure as defined in claim 27 wherein said secondary playing surface is reversible and has a different three-dimensional topography on opposed sides thereof.

29. A playing structure as defined in claim 26 further including side walls on selected sides of said frame, said side walls presenting an interior surface having graphics thereon consistent with said secondary playing surface.

30. A playing structure comprising:

a plurality of playing structure modules arranged in an array, each of said playing structure modules including a frame having an open interior and a reversible top on said frame and vertically spaced from the surface on which said frame is located, the frame of at least one of said playing structure modules supporting a secondary playing surface below said reversible top, the reversible top of each playing structure module having a pair of opposed playing surfaces, each depicting a different landscape, at least one of the opposed playing surfaces of at least one reversible top having a three-dimensional topography wherein at least one reversible top on a frame supporting a secondary playing surface has at least one passage therethrough to permit access to said secondary playing surface through said reversible top and wherein the landscapes on each playing surface are depicted such that the landscape is visually fluid over adjacent playing surfaces when any one or all of said reversible tops are reversed.

31. A playing structure as defined in claim 30 wherein the opposed playing surfaces of at least one reversible top have different three-dimensional topographies.

32. A playing structure as defined in claim 31 wherein said playing structure modules are stackable to create three-dimensional arrays and wherein modules stacked on top of other playing structure modules are configured to permit access to the reversible tops of the playing structure modules below them.

33. A playing structure as defined in claim 30 further including sidewalls on selected sides of at least some said frames, said side walls presenting an interior surface having graphics thereon consistent with said secondary playing surface.

* * * * *